US005463926A

United States Patent [19]

Faughn

[11] Patent Number: 5,463,926

[45] Date of Patent: Nov. 7, 1995

[54] AUTOMATIC GUNTUBE EMBER EXTINGUISHER SYSTEM

[75] Inventor: Jim A. Faughn, Bel Air, Md.

[73] Assignee: The United States of America as represented by the Secretary of the Army, Washington, D.C.

[21] Appl. No.: 164,918

[22] Filed: Dec. 9, 1993

[51] Int. Cl.[6] ..... F41A 13/04

[52] U.S. Cl. ..... 89/1.2

[58] Field of Search ..... 89/1.2, 1.25, 14.1

[56] References Cited

U.S. PATENT DOCUMENTS

| | | | |
|---|---|---|---|
| 870,528 | 11/1907 | Emery | 89/1.2 |
| 1,423,757 | 7/1922 | Dawson et al. | 89/1.25 |
| 2,922,339 | 1/1960 | Hawkins | 89/14.1 |
| 4,657,086 | 4/1987 | Aanensen | 169/54 |

FOREIGN PATENT DOCUMENTS

| | | | |
|---|---|---|---|
| 403918 | 11/1909 | France | 89/1.2 |
| 7818 | of 1904 | United Kingdom | 89/14.1 |

*Primary Examiner*—Stephen C. Bentley
*Attorney, Agent, or Firm*—Freda L. Krosnick; Muzio B. Roberto

[57] ABSTRACT

An automatic liquid spraying system extinguishes burning embers and residue remaining after firing of a cannon assembly. The spraying system has nozzles mounted on moveable mounted arm means for spraying the liquid co-axially into the cannon tube breech and projectile area and onto the obturator spindle axis. In one embodiment, external electric and pneumatic powered sources provides the power to operate the system; and in another embodiment, a self-powered squirt gun type hydraulic source provides the power.

13 Claims, 14 Drawing Sheets

AUTOMATIC GUNTUBE EMBER EXTINGUISHER SYSTEM

GOVERNMENTAL INTEREST

The invention described herein may be manufactured, used and licensed by or for United States Government without payment to me of any royalty thereon.

BACKGROUND OF THE INVENTION

1. Field of the Invention

The present invention relates to a system for automatically extinguishing embers in a gun tube or a cannon tube assembly (the terms cannon tube and gun tube are used interchangeably herein; cannon tube is used henceforth for brevity.) More particularly, the invention pertains to an automatic liquid spraying system for extinguishing burning embers and/or residue remaining in a field artillery cannon assembly after firing.

2. Description of the Prior Art

The United States military uses various techniques to extinguish burning embers with respect to its weapon gun systems. The Army uses various types of wash systems for its large caliber cannon tubes. For example, the Army uses a high pressure air wash system upon the completion of its firing of the Shillelagh missile from the M60A2 tank. The Navy uses various types of wash systems on its large caliber cannon tubes. A government contractor proposed a system that is capable of spraying air and/or water into the cannon tube. Further the contractor performed basic experiments on blowing cloth rags out of cannon tubes with high pressure air jets. Another contractor built a hand held manual bore swab with a self contained water supply. Another contractor suggested swabbing the breech area with a rammer or sponge mechanism.

3. Specific Prior Art

Patent No. 4,657,086 to Oscar Aanensen, issued Apr. 14, 1987, discloses a fire extinguishing system for use on a helcopter deck. The system has sets of nozzles to direct jets of foam (or water) to extinguish embers and wash away the foam.

4. Advantages Over the Prior Art

The present invention pertains to a liquid spraying system for extinguishing burning embers and residue remaining in a cannon tube after firing. The system includes an automatic assembly which sprays a liquid medium such as water or chemical foam liquified solution into the cannon tube assembly after every round of ammunition is fired. The liquid medium is sprayed coaxially into a cannon tube breech area and onto an obturator spindle axis with sufficient impingement force to completely extinguish and/or eliminate any burning ember and residue which may be present.

The present invention solves age old problems associated with extinguishing burning embers that remain after the firing of a cannon. The invention solves problems associated with washing, swabbing, or spraying the cannon tube assembly to extinguish burning embers before the next propelling charge is placed into the cannon tube. The invention solves problems which have plagued artillerymen in situations involving weapons firing semi-fixed powder charges (combustible powder bags separate from projectile.) The placement of an explosive charge onto a burning or smoldering ember can result in a spontaneous detonation of the newly inserted propelling charge or powder bag which in turn, may cause a high order detonation of the projectile. Explosions of this magnitude can be castatrophic for the immediate cannon crew and equipment.

This invention is vastly different from any previous system of accomplishing the swabbing procedure to extinguish burning embers. Past and current systems are based on stone age technology of placing a sponge/mop/absorbent material on the end of a ramming staff or rod and dipping it into a bucket of water and then proceeding to manually swab the cannon tube assembly until the embers and residue are extinguished. This wets and consequently extinguishes any burning embers which may ignite a subsequent powder charge placed on top of them. This problem has been tolerated by artillerymen for centuries, since pre Civil War days through both World Wars, Korea, Vietnam, and even Desert Shield. Past and present artillerymen have swabbed the cannon tube to extinguish the burning embers in much the same way. The science of guns, cannons, and artillery pieces has kept pace with today's technology in some areas and yet has remained virtually unchanged in the swabbing area—until the event of the present invention.

Even the Army's latest version in the family of M109 Howitzers, the M109A6 (HIP), is a paradox of technology with its high tech electronics systems including land navigation, ballistic computers, planned automated loader and ramming systems, and automated gun pointing devices to insure rapid accurate fire, and yet the crew still uses a bucket, ramming staff, and sponge to swab the cannon tube assembly between rounds. The tube swabbing task is labor intensive and time consuming for the crew in comparison to an automated system. The task may pose a significant safety hazard if not performed correctly, may introduce various amounts of liquid into the breech, and may reduce the effectiveness and speed of firing the howitzer in sustained operations.

5. Statement of the Invention

In one embodiment of the invention, the system utilizes external electric and pneumatic power sources. The electric power for the system's components is supplied by an independent electrical power source. The pneumatic pressure is supplied by an electric compressor (or a high pressure air bottle with step down regulator) for actuating a rotary actuator and a spray arm assembly, and for providing air over liquid pressure for delivery of the sprayed liquid medium. Electrically operated solenoid valves control the flow of both liquid and air for cycling of the system. Electronic micro switches and an adjustable timer provides phase signals for precise operation of the system within extremely close operating and timing parameters. The system is equipped with a fail safe pneumatic emergency return button for powered return of the spray arm in the event of an electrical malfunction, and is also equipped with a redundant spring assisted manual return for the spray arm in the event of a pneumatic failure as well. The spray arm is under a protective cover and incorporates a safety restraint bar for manual stoppage of the arm as it returns to its starting or home position.

In another embodiment of the invention, the system utilizes an internal power source; that is, a self-powered hydraulic apparatus. This embodiment is based on principles of hydraulic fluid mechanics and simple mechanical type valves and actuating components for the transmission of liquid to a specially designed spraying mechanism. The system utilizes hydraulic pressure supplied by the cannon's recoiling action for the actuation of positioning mechanisms for a cannontube spray arm and an obturator spray arm, and to also provide hydraulic pressure for delivery of the sprayed liquid. In this embodiment, the system is entirely independent of any external power sources and is based on the basic operating principle of a common squirt gun. The squirt gun unit which operates after the cannon is fired, utilizes the kinetic energy of the cannon tube's recoil for its power. The spring loaded cylinder piston unit provides both suction and pressure of liquid for transfer into the various actuating mechanisms and eventually to the spray nozzles themselves.

Accordingly, under either embodiment of the invention, the system solves the prior art burning ember and residue problem by utilizing a spray assembly which automatically sprays liquid into the cannon tube assembly after every round has been fired. The spray assembly retracts to a safe position that allows the next loading to proceed. This is accomplished in a time frame of approximately 1.31 seconds with no human intervention. Accordingly, the system provides many improvements over prior art equipments employing buckets, ramming staffs, and sponge systems.

SUMMARY OF THE INVENTION

The present invention relates to an automatic liquid spraying system for extinguishing burning embers and residue and expelling gases remaining in a field artillery cannon assembly after firing.

Accordingly, it is an object of the invention to provide an automatic ember extinguisher system which sprays liquid into a cannon tube breech area and onto an obturator spindle area after every round of ammunition has been fired, which retracts to a safe position, and which allows the next loading procedure to proceed.

It is another object of the invention to provide an automatic ember extinguisher system which insures complete safety of the gun crew from spontaneous detonation of powder charges by automatically spraying a consistent or identical amount of liquid after each round, thus eliminating the possibility of human error in missing a swabbing procedure between rounds.

Another object of the invention is to provide an automatic ember extinguisher system in which a spray apparatus is used for introducing various liquid chemicals or liquids into the cannon tube assembly for erosion control and cooling.

Another object of the invention is to provide an automatic ember extinguisher system which reduces the logistics burden of supplying liquid to a field cannon by using less liquid per round than the manual swabbing technique and by eliminating wasted or spilled liquid from the bucket.

It is a further object to provide an automatic ember extinguisher system which is operated by external electric and pneumatic powered sources or by a self-powered hydraulic source.

Other objectives of the present invention will be apparent from the following detailed description of the invention.

BRIEF DESCRIPTION OF THE DRAWINGS

The foregoing and other objects, aspects, and uses and advantages of the present invention will be more fully appreciated as the same becomes better understood when considered in connection with the following accompanying drawings, in which.

DETAILED DESCRIPTION OF THE INVENTION

Figure 1:
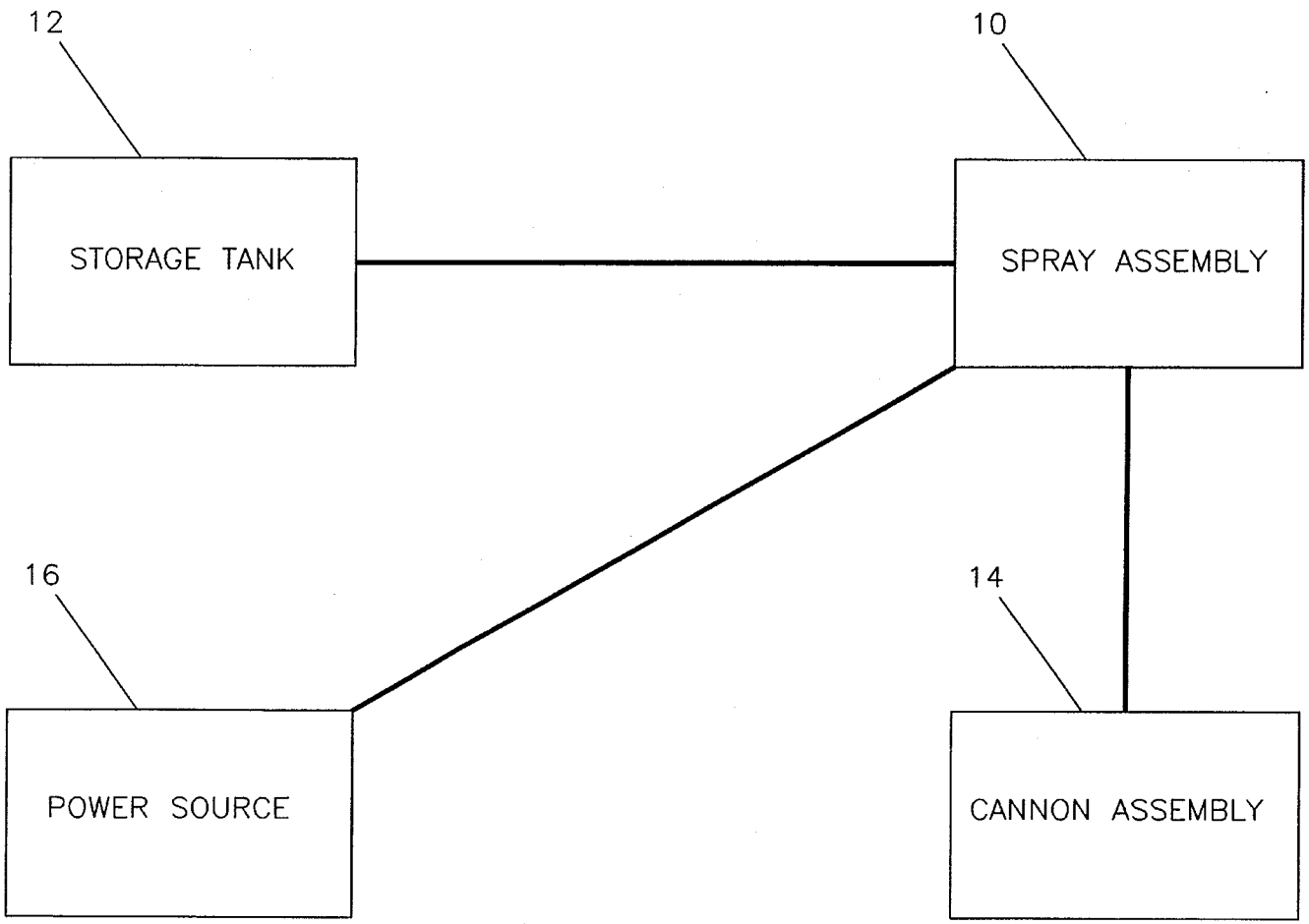
FIG. 1 is a block diagram of apparatus of an automatic cannon tube ember extinguisher system.

Referring to the drawings, like reference numerals represent identical or corresponding parts throughout the several views.

FIG. 1 discloses a block diagram of an automatic cannon tube ember extinguisher system which has a spray assembly 10 that is supplied by a liquid storage tank or container 12. The spray assembly 10 automatically sprays the liquid into a cannon assembly 14 after the firing of each round of ammunition. The liquid is sprayed with sufficient impingement force to completely extinguish and/or eliminate any burning embers which may be present in the cannon assembly 14. The spray assembly 10 is operated by a power source 16.

In the first embodiment of the invention, as shown in FIGS. 2 to 5, the system is operated by electric and pneumatic power sources which are external to the cannon assembly 14. In the second embodiment, as shown in FIGS. 6 to 14, the system is operated by a self-powered squirt gun type hydraulic source.

Figure 2:
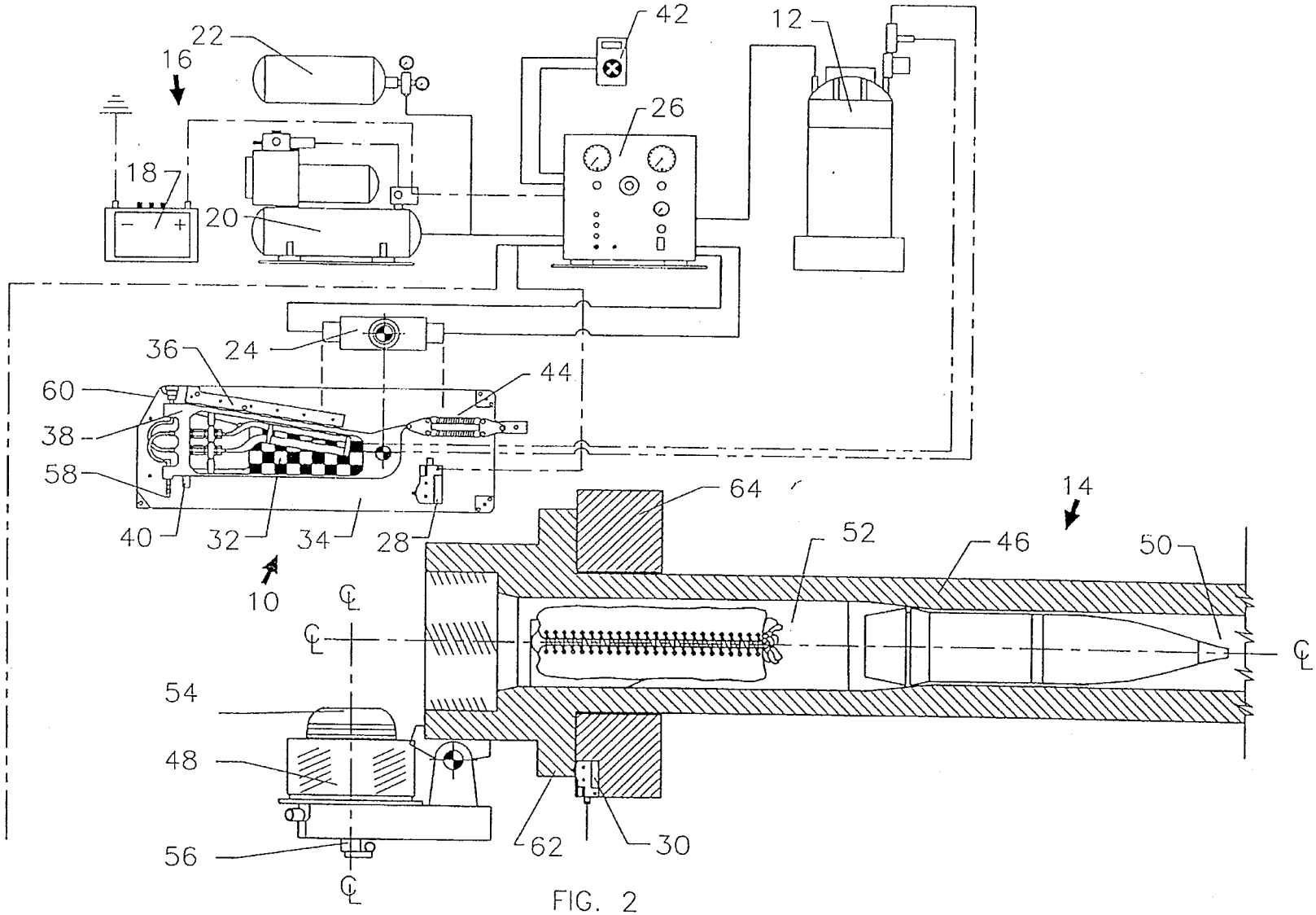
FIG. 2 is a perspective view of a first embodiment system including a storage tank, an electric and pneumatic power sources, a spray assembly, various control devices, and a cannon assembly (cannon tube in section) in an in-battery position.
Figure 3:
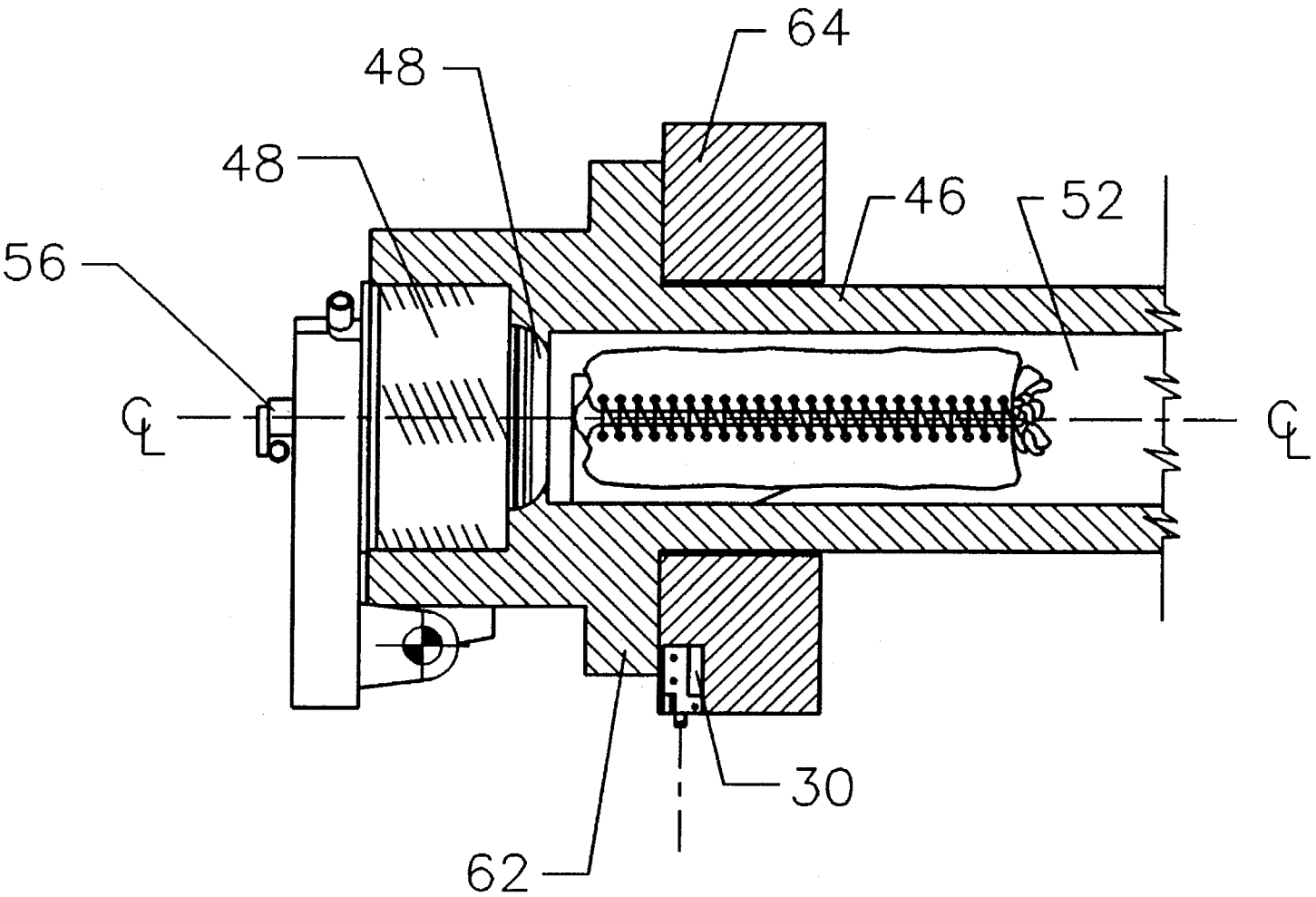
FIG. 3 is a perspective view of a breechblock in a closed position and the cannon tube (partial section) before firing.
Figure 4:
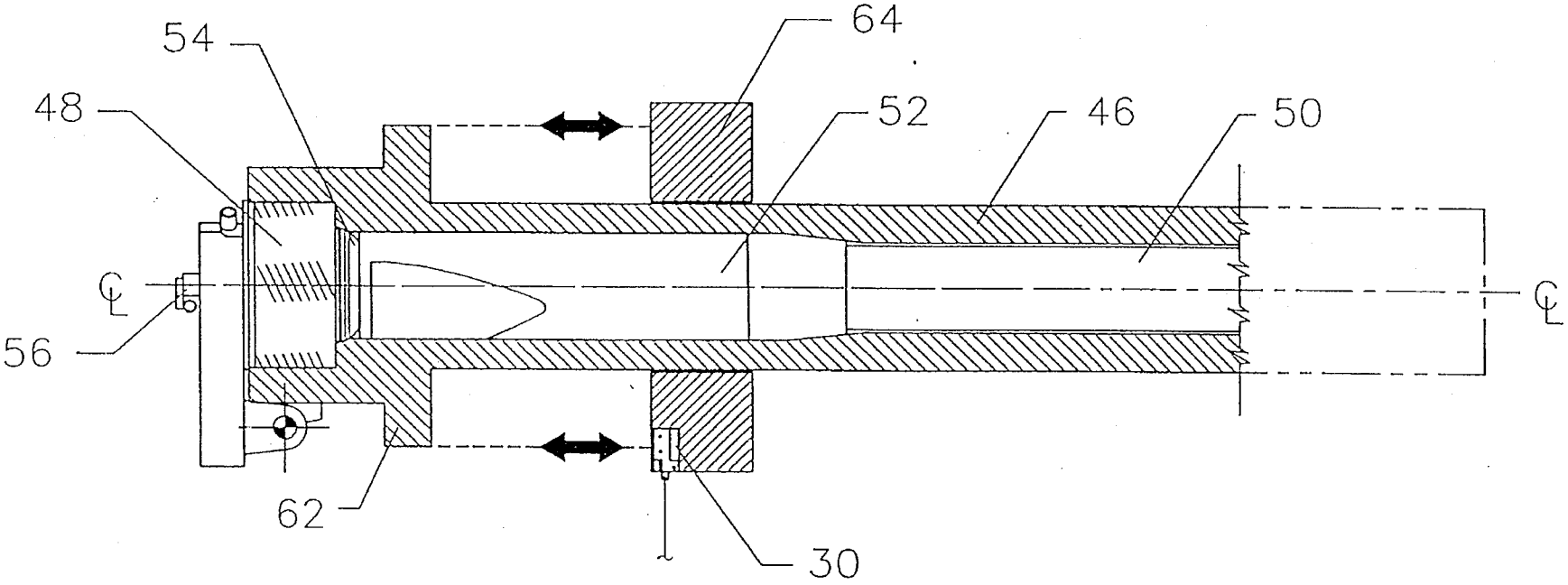
FIG. 4 is a view similar to FIG. 3 illustrating a recoil position after firing.

FIRST EMBODIMENT OF THE INVENTION:

The first embodiment is a system which is referred to in the field of U.S. Army artillery cannonry as an Automatic Guntube Ember Extinguisher (AGEEX) system. This embodiment is operated by electric and pneumatic power sources that are external to the cannon assembly 14. Referring to FIG. 2, the electric power for the system's components is supplied by a battery 18 which is a conventional 24 volt vehicle battery or an independent electrical power source. The pressure for the pneumatic power source is supplied by an electrically or hydraulically powered compressor 20 or by a high pressure air bottle 22 with a step down regulator. The electrically powered compressor 20 provides air pressure and/or a pressure vessel for stored compressive gases. The pneumatic pressure actuates a rotary actuator 24 of the spray assembly 10 and provides air over liquid pressure for delivery of a sprayed liquid medium. The liquid medium may be water, a chemical foam liquidified solution, or a similar extinguishing medium. A control box 26 is provided for controlling the electric power source 16 and the pneumatic power source 20 or 22. The control box 26 is operatively connected to the spray assembly 10 and the cannon assembly 14. The connecting lines to the spray assembly 10 and the cannon assembly 14 include limit switches 28 and 30, respectively. The liquid storage tank 12 with its valve controls are operatively connected to the spray assembly 10 and the control box 26. Electrically operated solenoid valves (included in control box 26) control the flow of both the liquid and air for cycling within the system. Electronic micro switches (included in control box 26) and tenth of a second adjustable timer (included in control box 26) provide phase signals for precise operation of the system within extremely close operating and timing parameters.

Figure 5:
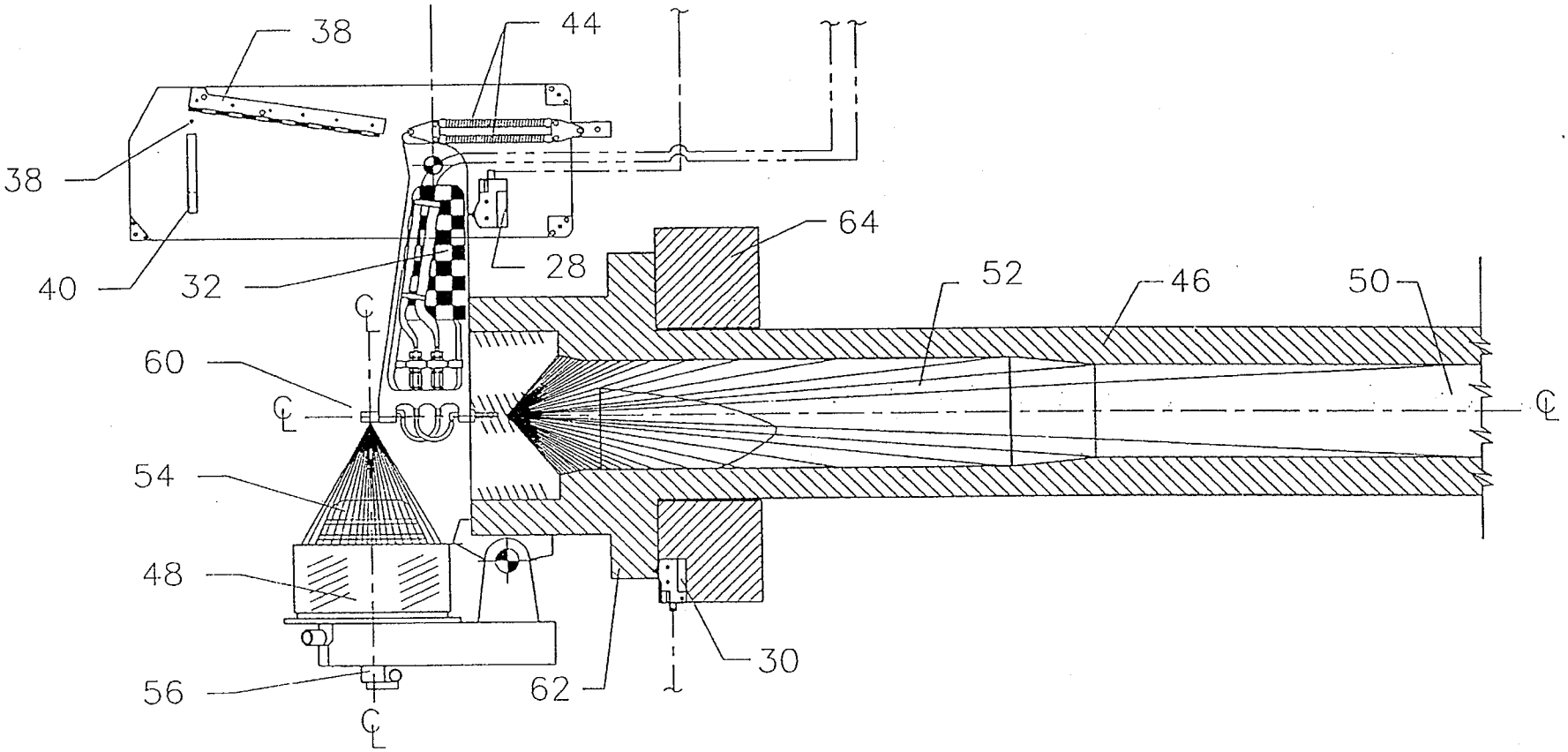
FIG. 5 is a perspective view of a breechblock in an open position and shows the interaction of the spray assembly with the cannon assembly (partial section).
Figure 6:
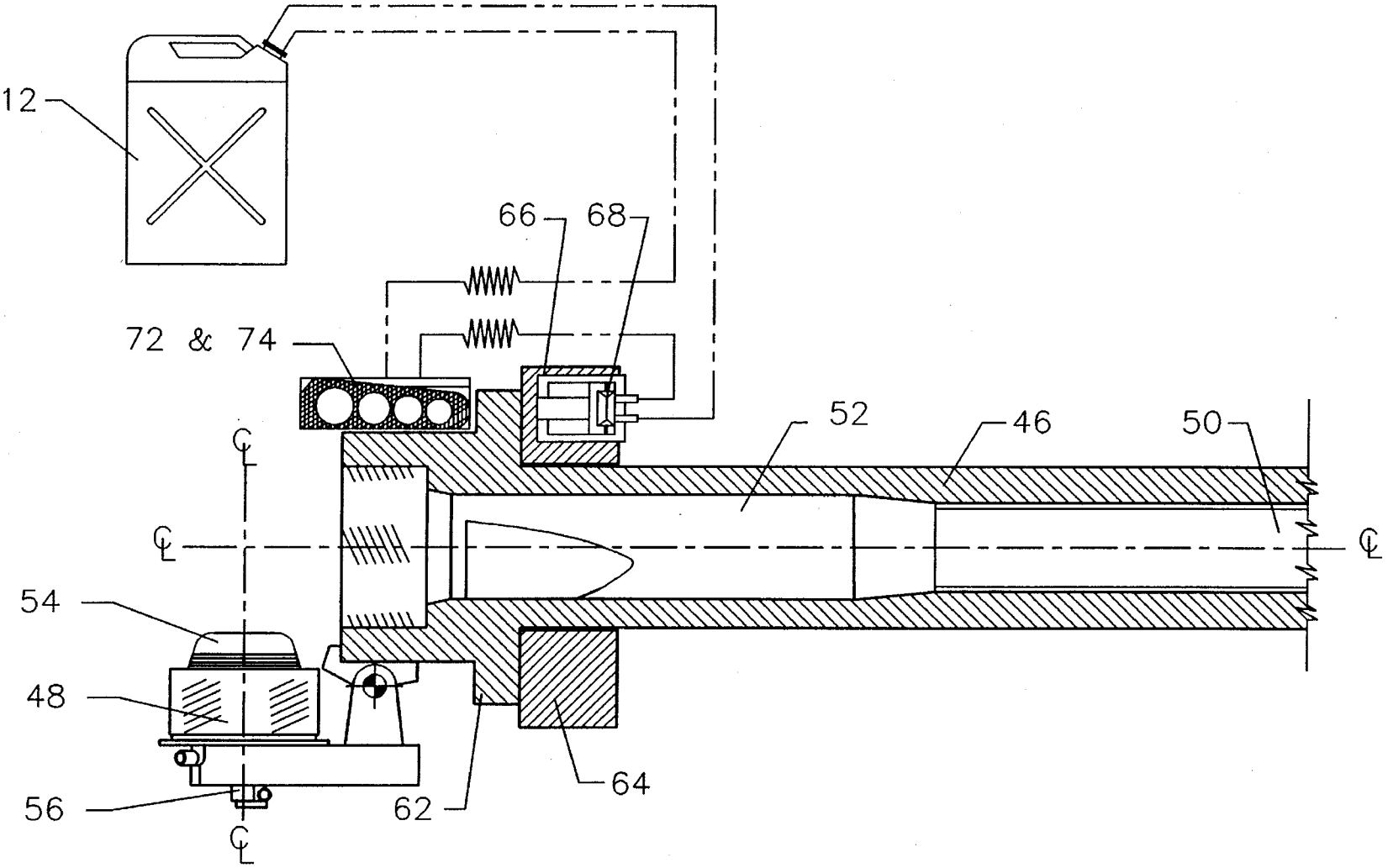
FIG. 6 is a view similar to FIG. 2, showing a second embodiment system wherein the spray apparatus is mounted on the cannon assembly.
Figure 7:
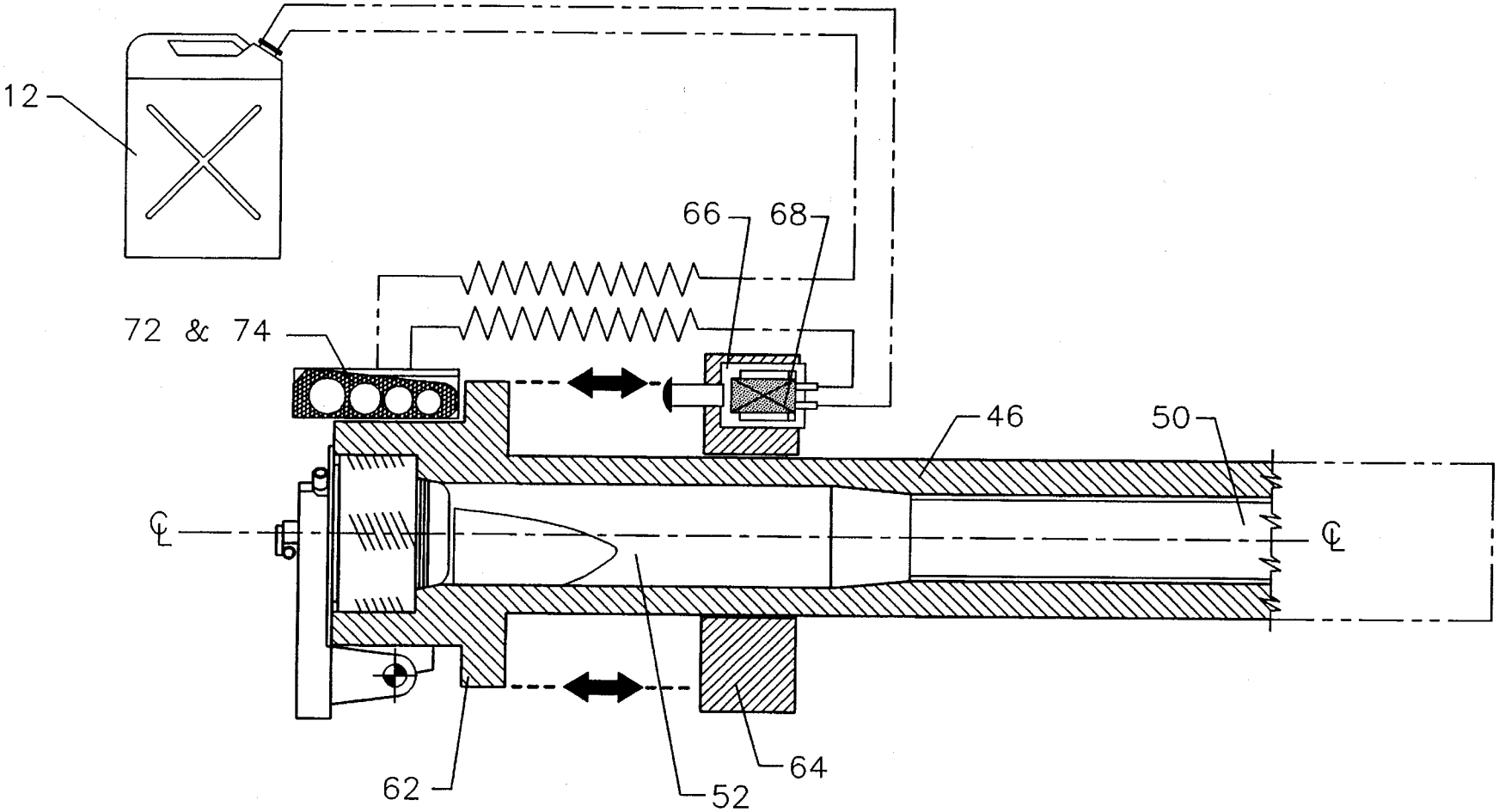
FIG. 7 is a second embodiment view similar to FIG. 4.
Figure 8:
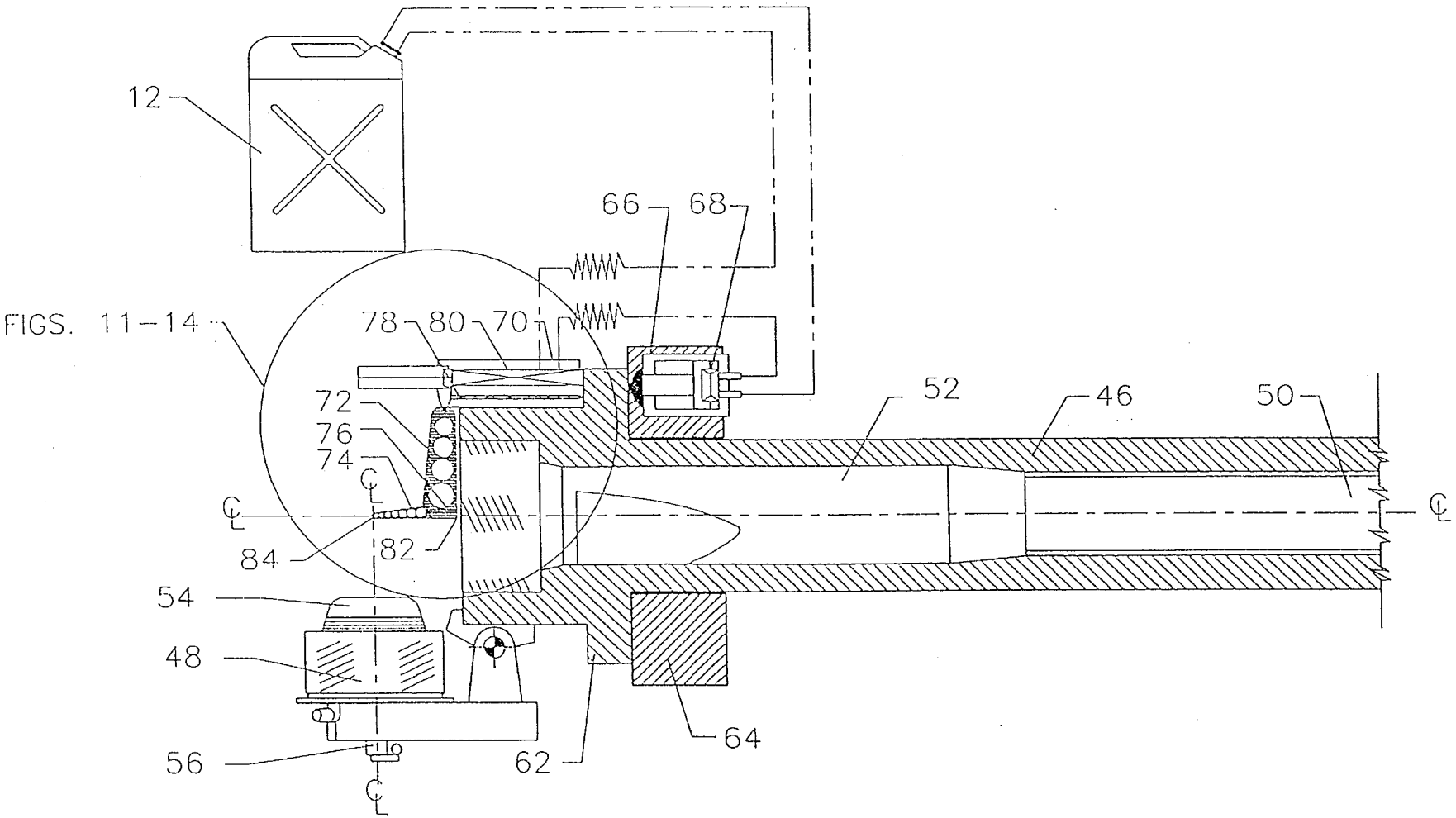
FIG. 8 is a perspective view of the second embodiment system including a self-powered source supported on the cannon mount and the spray assembly in an operative position.
Figure 9:
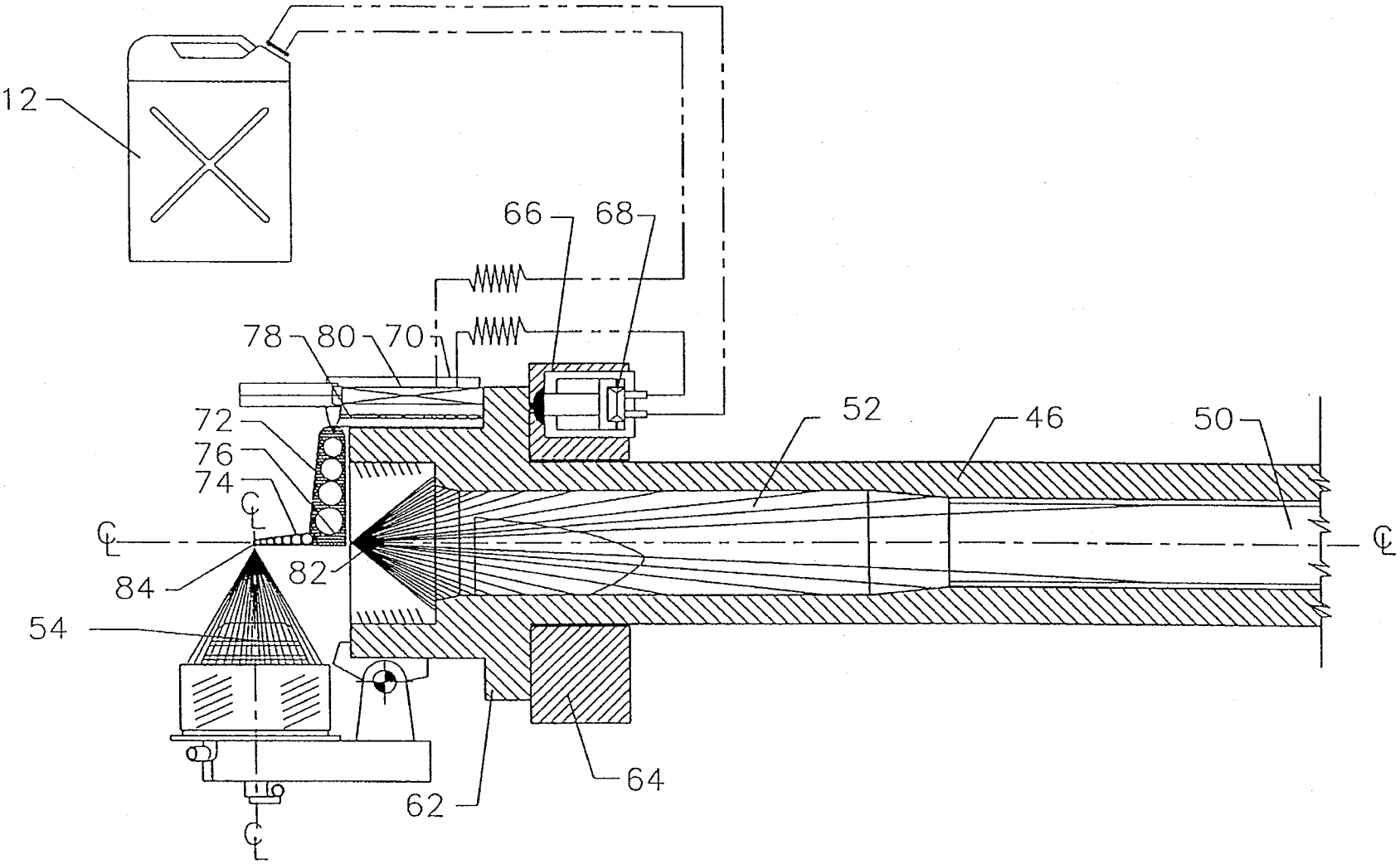
FIG. 9 is a second embodiment view similar to FIG. 5.
Figure 10:
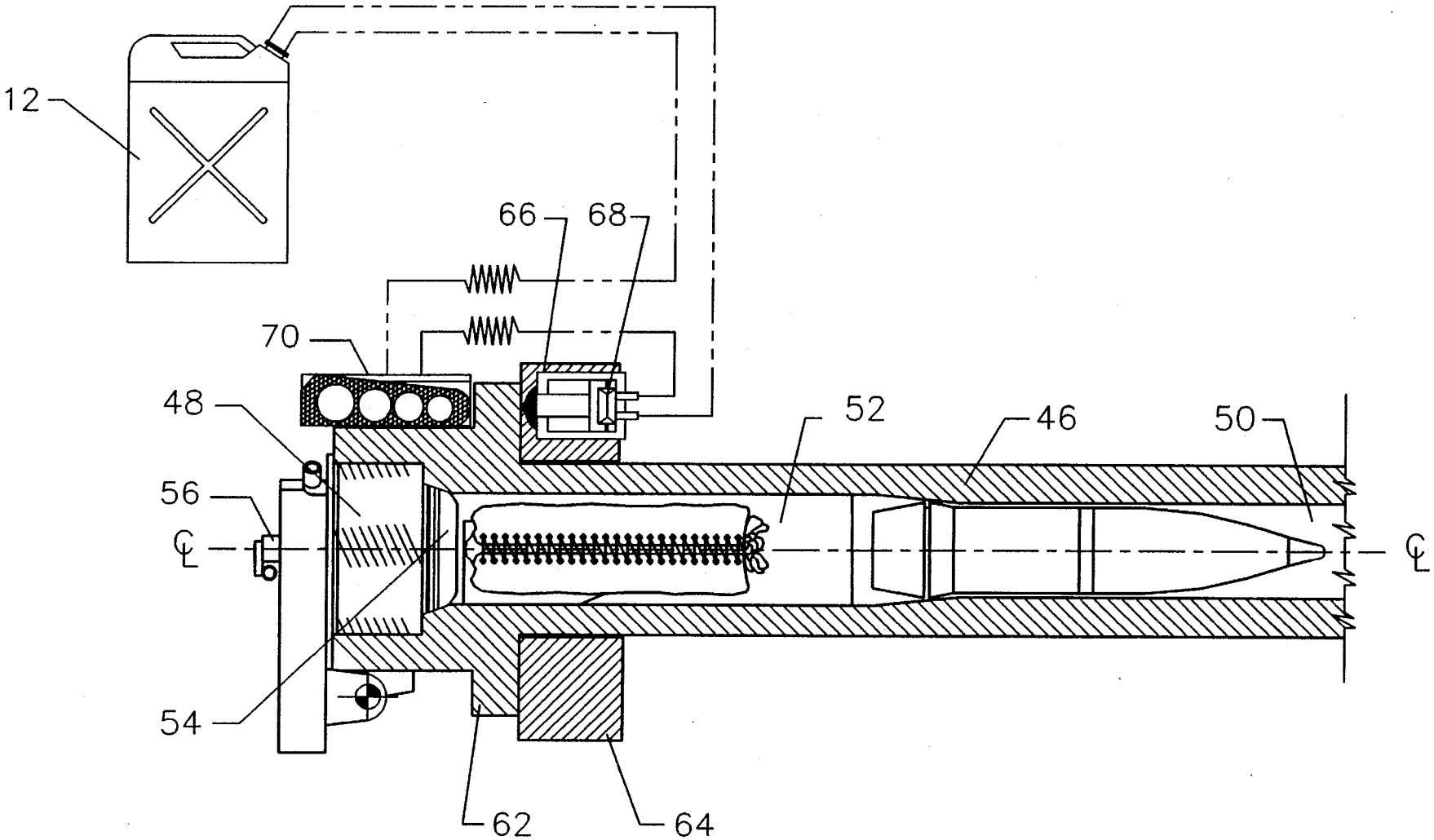
FIG. 10 is a second embodiment view similar to FIG. 3.
Figure 11:
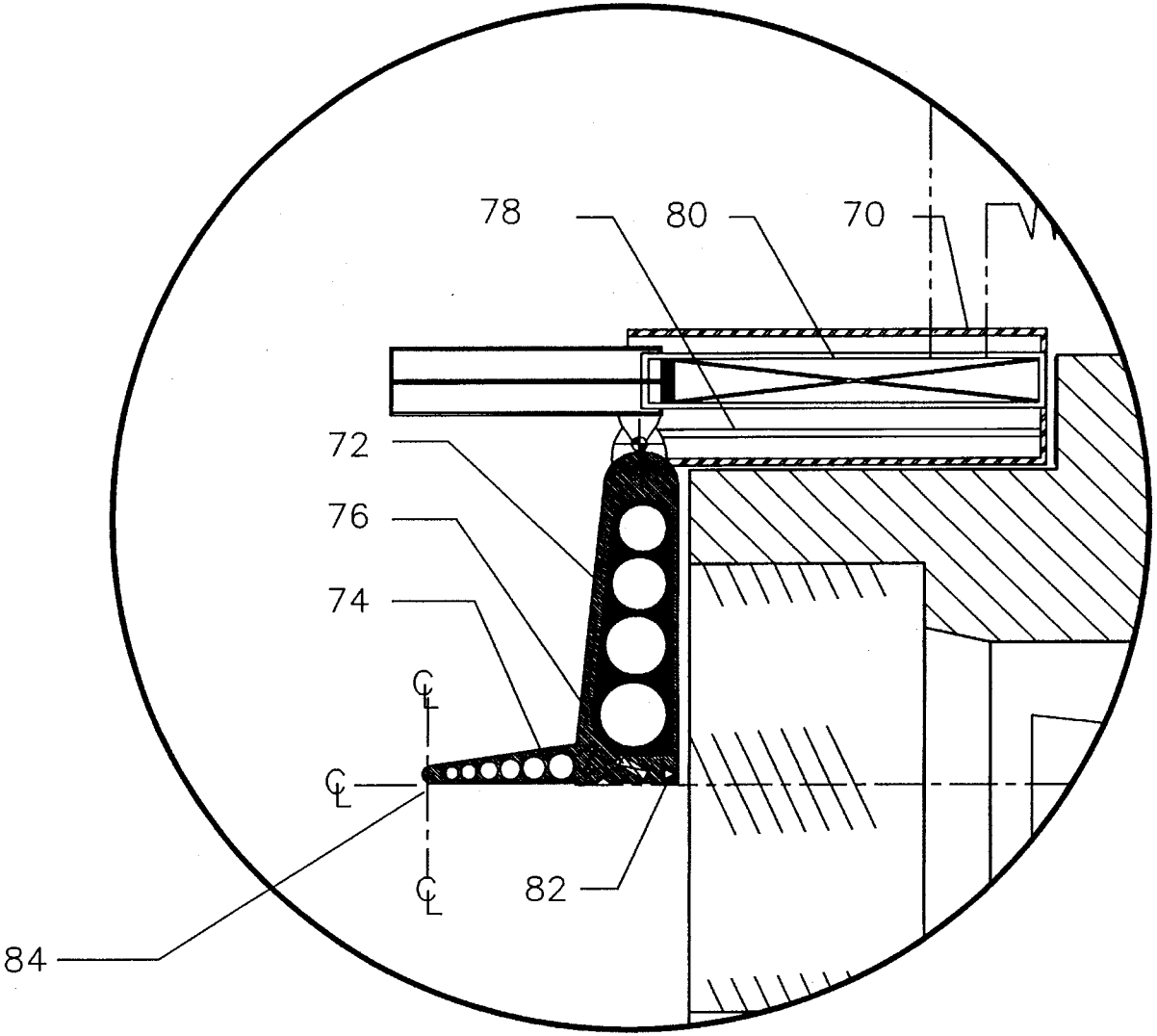
FIG. 11 is an exploded view of an encircled section of FIG. 8 showing both spray arms extended in an operative position.
Figure 12:
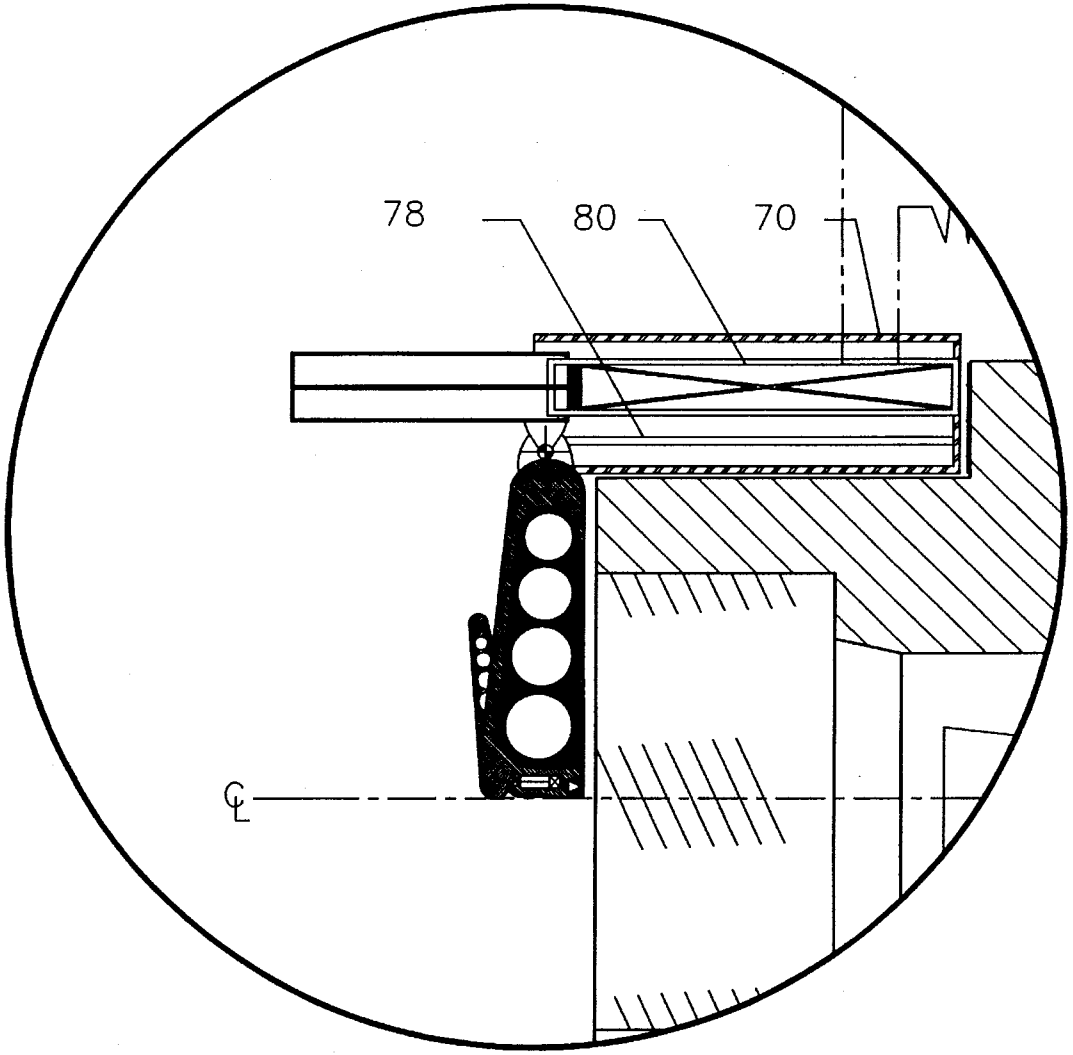
FIG. 12 is another exploded view of the encircled section of FIG. 8 showing both spray arms in a folded vertical position outside of the spray housing.
Figure 13:
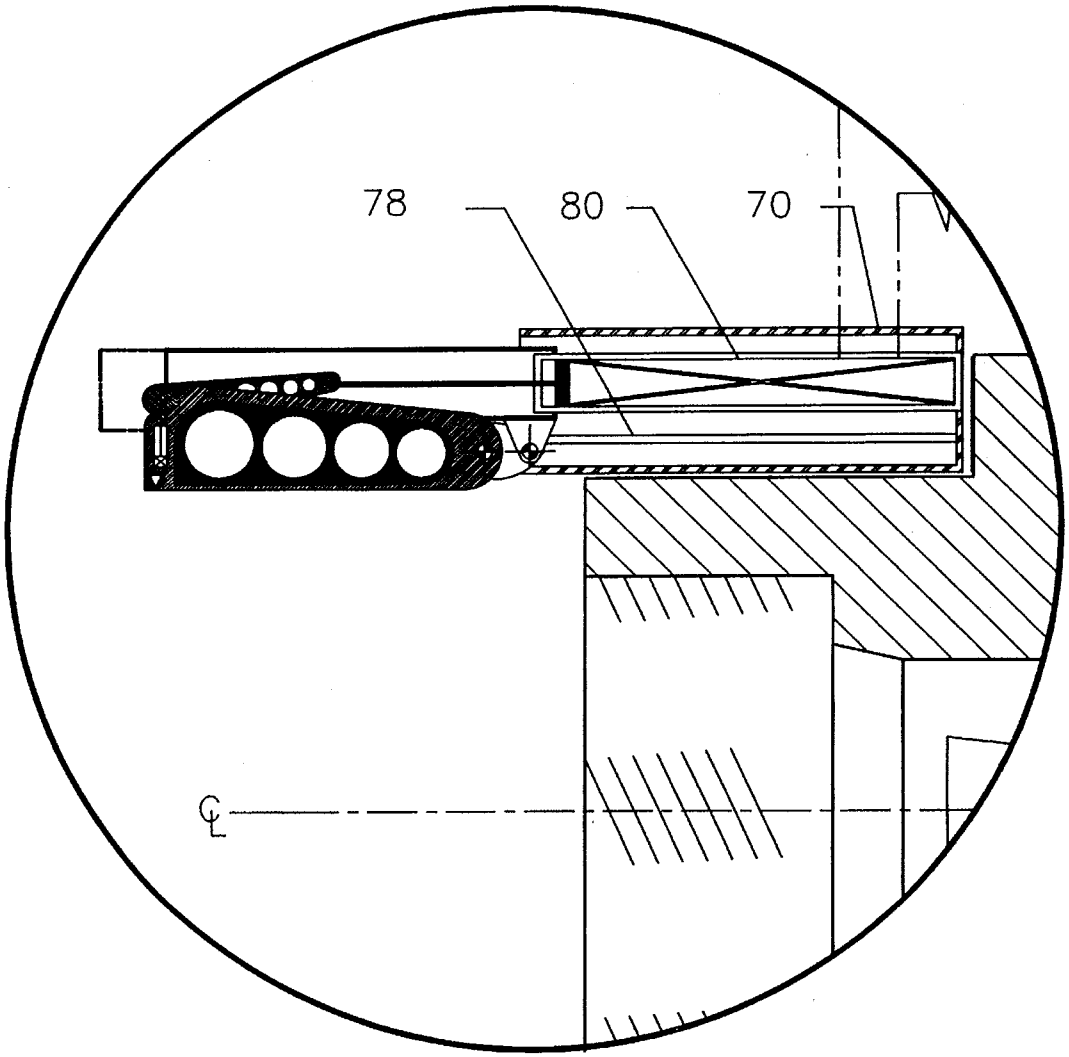
FIG. 13 is another exploded view of the encircled section of FIG. 8 showing both spray arms in a folded horizontal position outside of the spray housing.
Figure 14:
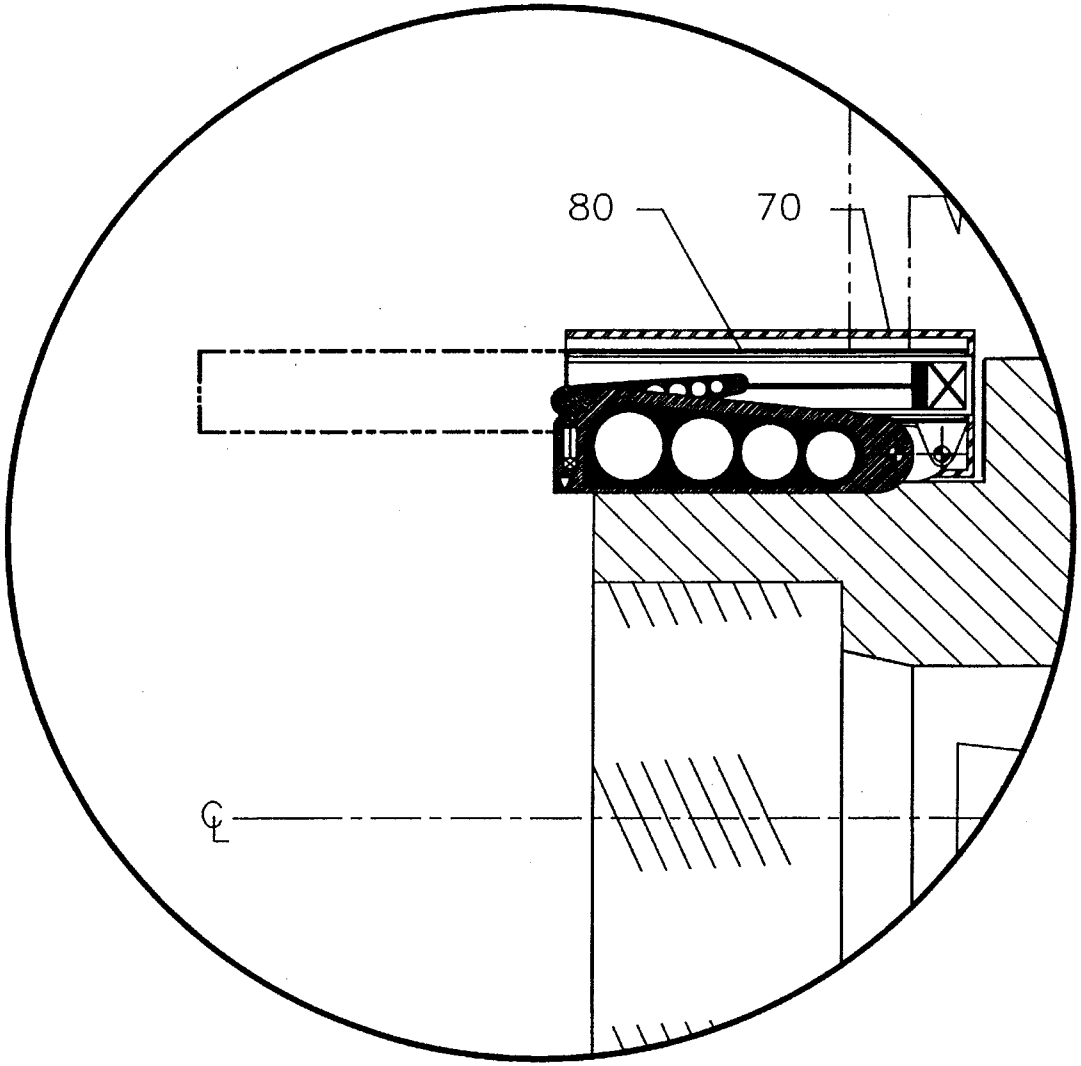
FIG. 14 is another exploded view of the encircled section of FIG. 8 showing both spray arms in a folded position inside of the spray housing.

The spray assembly 10 has an elongated arm member 32 which is mounted to pivot from its stowed (home) horizontal position in FIG. 2 to an operational vertical position in FIG. 5. The spray assembly 10 is under a protective cover (not shown) mounted on a housing 34 which protects the spray arm 32 when it is in the home position. The housing 34 incorporates a safety restraint bar 36 for manual stoppage of the arm 32 as it returns to the home position. When not in use, the arm 32 is prevented from accidental deployment or movement by a travel lock/stow pin 38 which secures the arm 32 in an immobile position. A pin 38 can also be utilized as a safety precaution item in view of the pivotal movements of the arm 32. The arm 32 is additionally supported in the home position by an arm support guide 40. The system is equipped with a fail safe pneumatic emergency return button 42 via control box 26 for the powered return of the arm 32 in the even of an electrical malfunction. Further, the system is also equipped with a redundant tension spring assisted manual unit 44 for the return of the arm 32 in the event of a pneumatic failure. Additionally, since the system is operational when pressure, safety relief valves have been installed within the system where appropriate to defeat any high pressure condition which may arise and would pose a potential safety hazard.

The cannon assembly 14 comprises a cannon tube unit 46 and a breechblock unit 48. The cannon tube 46 has an elongated chamber having a front section 50 which constitutes a housing for a projectile and a rear section 52 which constitutes a housing for a propelling powder charge. The front section 50 has a forward open end for the exiting of the projectile. The rear powder section 52 has a rearward open end prior to and after the firing of the projectile. The breechblock 48 has an integral constructed obturator spindle 54 attached thereto. The breechblock 48 is a conventional pivotally mounted closure with a hinge for closing the rear opening of the cannon tube 46 during the firing operation. A firing mechanism 56 is mounted on the breechblock 48 for firing the cannon.

The spray arm 32 has at least two nozzles (see FIGS. 2 and 5); namely, a nozzle 58 for spraying liquid co-axially into the powder section 52 and the projectile section 50; and a nozzle 60 for spraying liquid onto the axis of the obturator spindle 54 of the breechblock 48.

The cannon tube 46 has an upstanding rib member or a breech flange 62 which is made as an integral structural part of the cannon tube 46. The cannon tube 46 is movably supported on a cannon mount 64 which is stationary. During the firing operation, the cannon tube 46 and breech flange 62 move in the opposite direction of the projectile in recoil away from the cannon mount 64. The breechblock 48 is opened when the cannon tube 46 comes out of recoil and attains an in-battery position. The spray arm 32 now rotates counterclockwise into the spraying position and the spraying operation begins. After spraying, the return action of the rotary actuator 24 rotates the spray arm 32 clockwise into the home position in the housing 34.

OPERATION OF THE FIRST EMBODIMENT

Initially, the liquid storage tank 12 is filled with the liquid. All travel lock and stowage pins 38 on the spray assembly 10 are released and stowed. The system is connected to the battery for electrical power. The appropriate switches are actuated to make the system operational. Once the system has attained full system pressure it is mechanically operational. In actual practice, it is necessary to prime the supply lines with liquid. This can be accomplished by actuating the system through several test cycles (system's test cycle switches in control box 26 and located on pneumatic emergency return button housing 42) to pump liquid up to the nozzles 58, 60 and for a final system's operational check. The system is now fully operational and dependant on the firing of the cannon assembly for automatic cycling.

The cannon assembly 14 is readied by seating a projectile in the projectile section 50 of the cannon tube 46 by ramming. A propelling charge is loaded into the powder chamber 52. The breechblock 48 is closed. The primer is inserted into the firing mechanism 56. The cannon is fired by striking the primer which initiates the detonation of the propelling charge which causes expanding combustion gases to push the seated projectile down the cannon tube 46 which eventually exits the muzzle end. Simultaneously, the cannon tube 46 and the breech flange 62 move in the opposite direction of the projectile in recoil (see FIG. 4) away from the cannon mount 64. The recoiling cannon tube 46 closes the arm rotation limit switch 30. As the cannon tube 46 finishes its recoil cycle the breechblock 48 is automatically opened just prior to the cannon tube attaining the in-battery position. Whereupon the breech flange 62 strikes the arm rotation limit switch 30 which signals the timer to start, which, in turn, opens the solenoid valve in the control box 26. This valve delivers the pneumatic pressure to the pneumatic rotary actuator 24 which rotates the spray arm 32 counterclockwise through a 90 degree arc. When the spray arm 32 reaches it full 90 degree arc, it strikes the spray control limit switch 28, which signals the solenoid valve to open and deliver pneumatic pressure to the liquid tank 12. Liquid is now sprayed circumferentially in a full cone along the cannon tube axis and beyond the powder section 52 and into the projectile section 50. Also, liquid is concomitantly sprayed in a full cone along the axis of the obturator spindle 54. Thus, burning embers are extinguished. As the timer times out it signals the solenoid valve to switch and deliver pressure to the rotary actuator 24 in the opposite direction causing the spray arm 32 to rotate clockwise towards its home position. As the spray arm 32 rotates homewards, the spray control limit switch 28 is closed, signaling the solenoid valve to stop the flow of liquid to the spray arm nozzles 58 and 60. Accordingly, the spray arm 32 is returned home in completion of one spray cycle and the system is now ready for another operational cycle.

SECOND EMBODIMENT OF THE INVENTION:

The second embodiment is a system which is referred to in the field of the U.S. Army artillery cannonry as an Automatic Gun Tube Ember Extinguisher (AGEEX II) or more commonly referred to the Squirt Gun. This embodiment is operated by a self-powered hydraulic source. The structure of the second embodiment as shown in FIGS. 6–14 is broadly similar to that of the first embodiment as shown in FIGS. 1–5.

Referring to FIGS. 6 to 14, the liquid storage tank or container 12 is a standard military 5 gallon can (NSN 7240-00-242-6153), commonly called a Jerry can. The container 12 is connected to a hydraulic cylinder mechanism 66 which houses a compression spring 68. All of which is mounted on the stationary cannon mount 64. The hydraulic mechanism 66 and the spring 68 jointly create a vacuum on the supply side of the system's actuating components. The force of the spring pressed hydraulic activated mechanism unit 66, 68 is counter to the forward recoil force of the cannon assembly 14. This function is more fully described in the operation hereinbelow.

A housing 70 houses a cannon tube spray arm 72 (a first spray arm) and a obturator spray arm 74 (a second spray arm) (see FIGS. 6 to 14). The obturator spray arm 74 is nested within the cannon tube spray arm 72 in the home position. The arm units 72, 74 are pivotally mounted with respect to each other. The obturator spray arm 74 is rotated both counterclockwise and clockwise in and out of its nested position in the cannon tube spray arm 72 by the spring return assisted hydraulic actuating mechanism 76. The housing 70 has a guide track 78 and a spring loaded return hydraulic actuating mechanism 80 which guides and positions the spray arm units 72, 74 as they rotate downwardly in a counterclockwise movement from the home position within the housing 70 to their extended operative position. The cannon tube spray arm 72 which holds a cannon tube spray nozzle 82 directs a liquid spray co-axially into the rear breech powder section 52 and the front projectile section 50. The obturator spray arm 74 which holds a obturator spray nozzle 84 directs the liquid spray onto the axis of the obturator spindle 54. Thus, the hydraulic actuating mechanism 80 rotates the arm unit 72, 74 outwardly in a counterclockwise motion to a full spray position and returns the arm units 72, 74 to the home position.

OPERATION OF THE SECOND EMBODIMENT

The operation of the second embodiment is similar to the operation of the first embodiment. Initially the liquid storage tank 12 is filled with the liquid. All travel lock and stowage pins on the spray arm units 72, 74 are released and stowed. The appropriate valves are actuated to make the system fully operational. In actual practice, it may be necessary to prime the liquid supply lines with liquid. This can be accomplished by using a rubber primer bulb and bleed off valve. This will insure that liquid will be sprayed at the first firing of the cannon. The liquid tank 12 is vented to eliminate any vacuum caused by the displacement of the liquid. In addition, after the cannon is fired in the second embodiment, the recoiling cannon tube 46 allows the spring loaded hydraulic plunger unit 66, 68 to expand causing a vacuum which pulls liquid from the liquid tank 12. The breechblock 48 opens as the cannon tube 46 returns to in-battery position and the breech flange 62 strikes the hydraulic unit 66, 68. The plunger of hydraulic unit 66 compresses the chamber volume within the hydraulic unit 66 and places the liquid under pressure. The liquid is forced to the spray arm housing 70 where it activates the spring return assisted hydraulic cylinder actuating mechanism 80 which moves the spray arm units 72, 74 rearwardly along the guide track 78. When the spray arm units 72, 74 reach their end of travel the arm units 72, 74 are cammed downwardly counterclockwise in a 90 degree arc. When the cannon tube spray arm 72 reaches its end of travel the obturator spray arm 74 is rotated downwardly counterclockwise in a 90 degree arc by the spring return assisted hydraulic actuating mechanism 76. When both arms 72, 74 have attained their full travel, liquid under pressure is sprayed into the breech powder area 52, front projectile section 50, and onto the obturator spindle area 54. After the embers have been extinguished and as the pressure declines in the system, the spring return pressure in the spring return assisted hydraulic actuating mechanism 76 reverses the procedure and rotates the obturator spray arm 74 clockwise to the home seat within the cannon tube spray arm 72. Then the spray arm units 72, 74 rotate upwardly clockwise to 0 degrees and returns forwardly in the guide track 78 to the home position by the return spring force in the actuating mechanism 80. Accordingly, the spray arm units 72, 74 return to the home position in spray housing 70 at the completion of one spray cycle. The system is now ready for another operational cycle.

Obviously, numerous modifications and variations of the present invention are possible in light of the above disclosure. The automatic ember extinguisher system can be used with any type of gun tube or cannon tube assembly or any type of equipment where ember extinguishers are required. Further, the first embodiment system with the electric and pneumatic power sources may be modified to include as an option, the self-powered hydraulic power source of the second embodiment. It is therefore to be understood that the present invention can be practiced otherwise than as specifically described herein and still will be within the spirit scope of the appended claims.

What is claimed:

1. An automatic liquid spraying system for extinguishing burning embers and residue remaining in a cannon assembly after firing of a projectile, comprising in combination:

means for supplying a fire-extinguishing liquid medium to the rear powder section; the front projectile section; and onto the obturator axis;

the cannon assembly including an elongated chamber including a forward section and a rear section;

the forward section adapted for housing the projectile and having a forward open end for the exiting of the projectile; the rear section adapted for housing a propelling powder charge and having a rearward open end;

the cannon assembly including a pivotally mounted breechblock means for closing the rearward open end during firing;

means operatively associated with the liquid supply means for periodically spraying the liquid medium into the cannon assembly after the firing of the projectile; and means for providing power to operate the system.

2. A system as defined in claim 1, wherein the fire extinguishing liquid medium is water.

3. A system as defined in claim 1, wherein the fire extinguishing liquid medium is a chemical foam liquified solution.

4. A system as defined in claim 1, wherein the pivotally mounted breechblock means includes a breechblock, and an obturator spindle and a firing mechanism mounted on the breechblock.

5. A system as defined in claim 1, wherein the spraying means includes a mechanically-actuated arm means and nozzle means mounted on the arm means.

6. A system as defined in claim 1, wherein the cannon assembly is movable supported on a stationary mount and wherein the recoil force developed from the firing of the projectile moves the cannon assembly rearwardly and its forward movement is stopped by a flange on the cannon tube abutting the stationary mount whereby means are activated to operate the spray assembly.

7. A system as defined in claim 1, wherein the power means for operating the system is a self-powered hydraulic source.

8. An automatic liquid spraying system for extinguishing burning embers and residue remaining in a gun assembly after firing of a projectile, comprising in combination: means for supplying a fire extinguishing liquid medium to the gun assembly;

the gun assembly having an elongated chamber; the chamber adapted for housing the projectile; the gun assembly having a pivotally mounted breechblock means which includes a breechblock, and an obturator spindle and a firing mechanism mounted on the breechblock for closing the rearward open end during firing;

means operatively associated with the liquid supply means for automatically spraying the fire extinguishing liquid medium co-axially into the chamber and onto the obturator spindle axis after the firing of the projectile; and a self-powered hydraulic source for providing power to operate the system.

9. A system as defined in claim 8, wherein the fire extinguishing liquid medium is water.

10. A system as defined in claim 8, wherein the fire extinguishing liquid medium is a chemical foam liquified solution.

11. A system as defined in claim 8, wherein the pivotally mounted breechblock means includes a breechblock, and an obturator spindle and firing mechanism mounted on the breechblock.

12. A system as defined in claim 8, wherein the spraying means includes a hydraulic/spring-actuated arm means and nozzle means mounted on the arm means.

13. A system as defined in claim 8, wherein the gun assembly is movably supported on a stationary mount and wherein the recoil force developed from the firing of the projectile moves the gun assembly rearwardly and,its forward movement is stopped by flange on the gun tube abutting the stationary mount whereby means are activated to operate the spray assembly.

* * * * *